United States Patent [19]

Reil

[11] 4,445,309

[45] May 1, 1984

[54] METHOD OF MAKING A LIQUID PACKAGING CONTAINER WITH POURING SPOUT AND AIR INLET

[75] Inventor: Wilhelm Reil, Bensheim-Auerbach, Fed. Rep. of Germany

[73] Assignee: Tetra Pak Developpement S.A., Fed. Rep. of Germany

[21] Appl. No.: 431,412

[22] Filed: Sep. 30, 1982

Related U.S. Application Data

[62] Division of Ser. No. 179,331, Aug. 18, 1980, Pat. No. 4,367,828.

[51] Int. Cl.[3] ..... B65B 61/18

[52] U.S. Cl. ..... 53/410; 53/469; 53/482

[58] Field of Search ..... 222/478, 541, 574, 527, 222/529; 229/7 R, 17 R; 206/604, 622; 53/577, 579, 591, 133, 412, 469, 482, 410; 493/87, 212, 930, 963

[56] References Cited

U.S. PATENT DOCUMENTS

| | | | |
|---|---|---|---|
| 3,184,895 | 5/1965 | O'Connor | 53/412 |
| 3,404,988 | 10/1968 | Rausing | 229/7 R |
| 3,510,054 | 5/1970 | Sanni et al. | 229/7 R X |
| 3,552,631 | 1/1971 | Fuchs | 229/7 R |
| 3,795,359 | 3/1974 | Rausing | 229/7 R |
| 3,797,726 | 3/1974 | Reil | 229/7 R X |

*Primary Examiner*—Stanley H. Tollberg
*Attorney, Agent, or Firm*—Biebel, French & Nauman

[57] ABSTRACT

The method of making a packaging container of board material for liquids, which has been rendered impermeable by an internal coating of plastic, in which the container is provided with a double thickness wall portion in which the interior communicates with the interior of the container, in which the container is first filled and closed and thereafter at least one score line for separation is applied to the double-thickness wall portion, and at least one narrow weld edge is applied to both sides of the double-thickness portion for sealing the score line, and closely adjacent to the score line, which weld portion may readily be severed by lifting a strip of the material by one of the walls which can be gripped by the fingers. In another aspect, weld seams are provided at both sides of a score line, and may be formed simultaneously with the forming of the score line.

3 Claims, 16 Drawing Figures

(D-D)

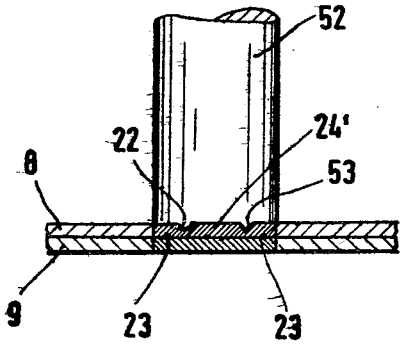
Fig.16
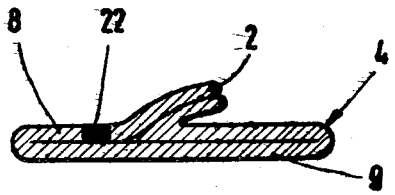
Fig.8 (C-C)
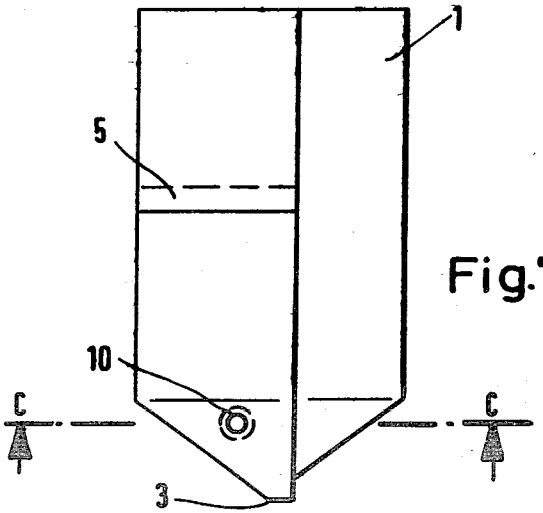
Fig.7

Fig.13 (B-B)
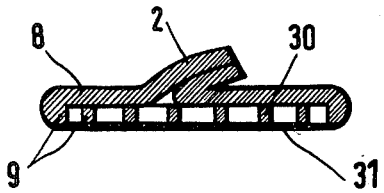
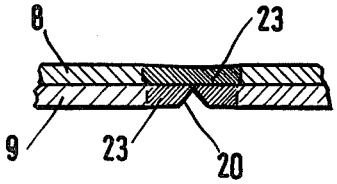
Fig.14 (A-A)
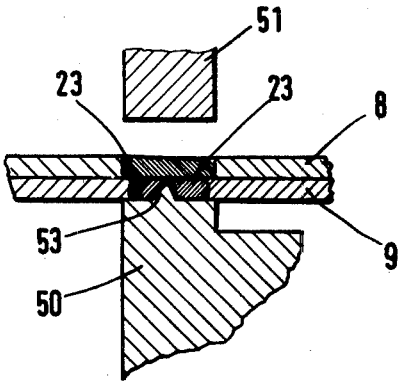
Fig.15

METHOD OF MAKING A LIQUID PACKAGING CONTAINER WITH POURING SPOUT AND AIR INLET

This is a divisional of application Serial No. 179,331 filed August 18, 1980, now U.S. Pat. No. 4,367,828 issued Jan. 11, 1983.

This invention relates to a packaging container of cardboard, paper or the like for liquids, the container being rendered impermeable by at least an internal plastic coating and having, at least at one end, a double thickness portion, the interior of which communicates with the interior of the container, the wall of said portion being provided with a seizable strip of cardboard.

It is known that milk, juices and water are at present available commercially in containers of this kind. These known containers are polyhedral in shape and more particularly are parallelepipeds, tetrahedrons, or cubes.

Production methods vary. One very practical way of producing such a container is to form a tube, flatten it, fill it, seal it transversely, and separate it from the tube. Containers of this kind have seams in two opposite lateral walls and one end-wall, or in two opposite end-walls and one lateral wall, in the form of double cardboard strips with a sealed seam which can be bent up and gripped.

Whether they are used for powdered and granular material, or for liquids, all packaging containers are faced with the problems of proper sealing and easy opening when it is desired to empty them. In this connection, a wide variety of opening means have been developed and are already known. One example is a known rectangular container having double-thickness triangular flaps formed on its opposite end-walls, the interior thereof communicating with the interior of the container. A double strip of cardboard with a sealing seam extends to the outer tip of the triangular flaps which, in the final shape of the container, are folded about an edge-line between one narrow lateral wall and one end-wall, and which are secured thereto by spot-sealing. In some designs of this known container, the opening means provided is in the form of a perforation-line, closed per se, and rectangular in plan view, located in the upper end-wall and extending downwardly for a short distance above the edge-line in the triangular flaps. Sealing is improved by welding a plastic cover-strip internally, at a certain distance from the perforation-line. Located within the perforation line, the projection of which is rectangular in plan view, in the vicinity of the edge-line, is a large weld-spot and, at a distance therefrom at the end remote from the edge-line, at least one other, smaller, weld-spot to which the plastic-coated strip of carrier-material, with the internally applied plastic cover-strip, is welded. This makes it possible, upon tearing off the strip of plastic formed by the closed perforation-line, to expose holes, within the area of the tear-off cardboard strip, the larger front opening being used as a pouring spout, while the one or two smaller rear openings are used as air-inlets. This provides a highly satisfactory opening means for a rectangular container which is fluid-tight and can be opened relatively easily (German Patent Application No. P 25 20 569.0-27).

Now it is the object of the invention to provide a liquid packaging container which is simple to produce, which stacks well for transportation, is reliably leak-proof prior to opening, and can easily be opened by the final consumer.

According to the invention, this object is achieved by providing at least one of the double-thickness portions with one or more score-lines and, closely adjacent thereto, at least one weld-seam by means of which the double-thickness portions are welded to one another in a fluid-tight manner.

This advantageous solution applies to all types of liquid packaging containers having the properties discussed above. By way of illustration, however, reference will be made to a rectangular container comprising two end-walls with adjoining double cardboard strips, and a weld-seam and double-thickness triangular flaps. However, the invention is not restricted to rectangular containers of this type.

The basic concept of the invention is based upon the fact that it is possible, with extremely simple tools, to arrange at the point in the container where the double-thickness portion is located, i.e. one of the triangular flaps, in one of the two superimposed walls a score-line and, thereafter or at the same time, a weld seam.

This seam-welds the two double superimposed wall portions, i.e. triangular flaps, together in a liquid-tight manner. This makes it possible to produce openings in any form in one or both wall portions, and these can be prepared, in a surprisingly simple manner, in the following way. In order to open the container prepared in the manner described above the cardboard strip located on at least one of the wall portions is gripped and pulled upwardly in the direction of a given marking. This applies tensile and compressive forces, in a very specific manner, to the weld-seam adjacent the weld-seam or seams near the score-lines. According to the invention, the score may be made in such a manner that the weld-seam which provides the liquid-tight seal is broken open in order to open the container. Another weld-seam, for example one located on the side of the wall portion facing the score-line, will then ensure that the piece of material on the opposite wall portion which faces the score-line and is not cut through, is left hanging. This makes it possible to produce an opening easily and satisfactorily in any desired form. In this connection, it is desirable for the weld-seam to be so narrow that it can be torn open by hand.

One preferred embodiment of the invention is characterized in that the score-line is in the form of a closed circle. With this design it is easily conceivable that the weld-seam and/or score-line may be provided in the form of a circle, an oval, a closed square, a rectangle, or the like, in the area where one wall portion lies above the other, in this case, in the double-thickness triangular flaps. According to the invention, it is important for the score-line to penetrate only into one of the wall portions in order to ensure that the other wall portion remains liquid-tight. Penetration of both walls would cause the container to leak at this point, especially since the interior of the wall portion, or triangular flap, is in communication with the interior of the container. However, it will be seen that by arranging the weld-seam at a distance around the closed score-line, the score-line is again sealed off, very simply, from the interior of the double-thickness wall portion i.e. the triangular flap. Now if a weld-seam is also arranged on the opposite side, i.e. within the score-line, this will mean that when the two wall portions are pulled apart, the inner area is left suspended from the opposite wall without any score-line, whereas the above-mentioned outer score-line, producing the liquid-seal, is broken open.

Depending upon the location of the score-line and the weld-seam or seams, it is quite simple to provide an air-inlet adjacent the conventional pouring spouts or to provide, in place of the conventional pouring spout, a novel pouring spout, or the two combined.

Another example of the invention is characterized in that the score-line is an uninterrupted perforation-line. The score-line described previously may be thought of either as an uninterrupted, i.e. continuous, score-line or, according to the present design, as a score-line along which the cut cardboard carrier strip is left standing in short sections. This interrupted score-line will be referred to hereinafter as a perforation-line. It is to be understood that the advantages mentioned hereinbefore are obtainable even if a perforation-line is used instead of a continuous score-line. Depending upon the type of packaging container, for example, it may be preferable to improve the seal, from the point of view of easy opening, by first perforating the cardboard carrier-material, then applying the coating, and finally producing the described weld-seam adjacent the perforation-line. The expert will have to decide in each case whether it is better to use a perforation-line or a score-line.

According to yet another example of the invention, a plurality of circular score-lines are provided in one of the double thickness wall portions, for the purpose of forming a pouring spout, whereas only one or two circular score-lines are provided in the other wall portion in order to form air-inlets. Furthermore, each circular area is at least partly welded to the respective opposing wall portion inside and outside the score-lines. In this design, the plurality of circular score-lines, for example, may be arranged in the lower triangular wall as a plurality of pouring spouts, whereas the one or two air-inlets are arranged in the upper triangular wall, namely the one extended towards the double-thickness triangular flap. As a rule, only one larger opening will be provided in the lower triangular wall as a pouring spout. In certain designs it may, however, be better to have a large number of small circular openings rather than one large opening, as a pouring outlet. The total number of small openings will be such as to provide an adequate flow of liquid with a "salt-shaker" effect. The advantage of having numerous small openings is that the lower wall portion, i.e. the triangular wall, remains without any openings at desired locations, for instance below the double cardboard strip, with sealing seam, in the upper triangular wall. The reason for having no score-lines, with narrow weld-seams on each side, in the lower triangular wall under the strip of cardboard, is that this avoids welding problems. For instance, there is a narrow gap where the double strip of cardboard is fitted to the upper end-wall, in which the back-up jaws of the welding unit do not work well, making it difficult to apply the narrow, liquid-tight weld-seams on both sides of the score-lines.

One preferred embodiment of the invention, already referred to, is characterized in that the double-thickness wall portion is in the form of triangular flaps, two sides of which are formed by fold-edges which meet at the outer apex to which the seizable double strip of cardboard, with sealing-seam, also runs, and in that the score-line in the triangular wall runs, with no double strip of cardboard transversely over the triangular flaps from one fold-edge to the other. In the case of a parallelepiped container, with the triangular flaps, this corresponds to the design mentioned briefly above, in which one large pouring spout is provided in the lower side of the double-thickness triangular flap, instead of a number of small circular outlet openings. If one imagines the double-thickness triangular flaps folded upwardly into the plane of the upper end-wall, and if one then imagines a view of the container from below, one perceives the score-line located in the triangular wall, with no double cardboard strip, preferably running from one fold-edge to the other transversely over the triangular flaps. In this case it is immaterial whether the score-line is in the form of an arc of constant or varying radius, or in the form of a straight line, or a plurality of straight lines arranged angled to one another. In any case, the double-thickness triangular flaps will be divided into two areas by the score-line and the adjacent weld-seam; namely one area on the side of the container, which is in communication with the interior thereof, and another more towards the outer apex of the triangular flaps which is sealed off from the interior of the container in a liquid-tight manner by the narrow weld-seam. When the double cardboard strip is grasped, the latter will ensure tearing off of the weld-seam which seals-in the liquid, thus producing a pouring spout.

In this connection it is particularly advantageous to provide a narrow welded edge, which is not adapted to be broken open, on the side of the perforation-line which faces the outer apex of the triangular flap and which is provided in the cardboard carrier-material prior to the plastic coating, and at a distance from the perforation-line. If the score-line is in the form of a perforation line, a seal is still provided by the plastic coating. In this design there is no need to provide the narrow welded edge on both sides of the score-line. It is only necessary to unite the partial area of the triangular flap facing the outer apex with the upper triangular wall and the double-thickness cardboard strip by welding, for example. As a result of this union, the perforation line is torn open when the cardboard strip is pulled up. In this case, the pouring spout is formed only when the container is torn along the perforation line, since this also destroys the sealing layer of plastic.

In another embodiment of the invention, however, the break-open weld-seam, sealing the interior of the container, also runs from one fold-edge to the other, at least on that side of the score-line which faces away from the outer apex. In this case, therefore, it is not the perforation-line but the continuous score-line which, produces a correspondingly large pouring spout in running from one fold-edge to the other. Before this pouring spout is formed, i.e. before the container is opened, it must be closed in a liquid-tight manner and the effect of the score-line, namely to eliminate the seal, must be eliminated by a weld-seam. For this reason a weld-seam is provided on that side of the continuous score-line which faces towards the interior of the container and which also runs from one fold-edge to the other, i.e. right along the continuous score-line, thus closing off the interior of the triangular flap from the outside in a liquid-tight manner from the scoring line out. It is desirable, however, to provide a welded-seam on both sides of the continuous score-line since, by this simple procedure, the partial area of the triangular flap, facing towards the outer apex thereof, remains adhering, and easy tearing off of the sealing weld-seam, upon opening the container, is assured.

Mention has already been made of the other preferred embodiment which, according to the invention, is characterized in that the numerous circular score-lines are arranged in the triangular wall, without double strips of cardboard, at a distance therefrom. Thus the score-lines, with weld-seams preferably arranged on both sides, are at a distance from the cardboard strip. This ensures fluid-tight welding, and there is no impairment of the double strip of cardboard due to the difficulty of applying counterpressure.

The invention also relates to a method for producing the packaging container described hereinbefore, which method is characterized in that after the packaging container has been formed, filled and closed, at least one narrow weld-edge, adapted to be broken open, is applied to the outwardly-projecting, double-thickness wall portion adjacent the score-line, for the purpose of uniting the two wall portions. The particular advantage of the new method is that the score-line and weld-seam are made only after the container has been filled and closed, an arrangement which produces considerable mechanical simplification. For instance, the machine which forms, fills, closes (by welding), and separates the container does not have to be complicated by additional machine-elements to produce an opening means. Instead, the latter can be achieved at a subsequent station where the double-thickness wall portion is not yet folded down around the edge-line between the upper end-wall and the lateral wall of the rectangular container, but projects laterally, for example in the plane of the upper end-wall.

According to the invention, therefore, it is also highly desirable, after the container has been filled and closed, for one or both wall portions to be provided with at least one continuous score-line, and for the narrow weld-edge to be applied on both sides thereof. The difference between this design and the one mentioned previously is that, in the case of the latter, the score-line may be either a continuous line or a perforation line, with further processing concentrated upon the application of the weld-seams. On the other hand, special preference is given to the arrangement of the continuous score-line in the latter embodiment, since this makes it possible to provide both the score-line and the weld-seam in one or both wall portions, more particularly the triangular walls, from one or both other sides, into the projecting partial area. In this connection, it is conceivable to use the same tool in order to make both the score-lines and the narrow weld-seams at the side of them, perhaps even simultaneously. It is obvious that the method for producing a packaging container of this kind can thus be simplified to a surprising extent.

As regards the apparatus for carrying out the method of the invention, a welding ram adapted to the shape of the narrow weld-seam or seams is designed to be heated and cooled in relation to a back-up jaw. A welding ram of this kind may be moved, in the manner described above, after the container has been filled and closed, laterally, e.g. from above and/or below, from the right and/or from the left, towards the double-thickness triangular flaps, in order to produce the said weld-seam or seams.

In this connection it is particularly desirable, according to the invention, for the welding ram to comprise a high-frequency welding coil. In the case of packaging materials coated with aluminum, it is particularly desirable to use known high-frequency welding technology, since this permits the use of very fine coils of the desired contours.

In the case of the equipment mentioned above for the execution of the production method according to the invention, and in the case of another specially preferred embodiment in which, according to the invention, the welding ram comprises cutters on the surface facing the back-up jaw, it is possible to design circular, semi-circular, oval, polygonal and other welding rams, making it possible to apply a score in the relevant wall portion simultaneously with the narrow weld-seam on one or both sides.

This provides considerable simplification of the production tools and of the production method, resulting in inexpensive production of a packaging container for liquids which is reliably leak-proof before it is opened with a single pull tab, in spide of the fact that the pouring spout is of simple design and easy to produce.

Further advantages, characteristics and possible applications of the present invention may be understood from the following description, in conjunction with the accompanying drawings, in which:

FIG. 7 is a plan view of the container in the condition shown in FIG. 2;

FIG. 8 is a section on line C—C in FIG. 7;

FIG. 13 is a cross-sectional view taken on line B—B in FIG. 10;

FIG. 14 is a cross-sectional view taken on line A—A in FIG. 9;

FIG. 15 shows the score-line and weld-seam being produced with a welding ram and counter-pressure ram;

FIG. 16 is a diagrammatic part-section through a cutting ram, showing the cut and welded areas in two triangular walls.

Figure 3:
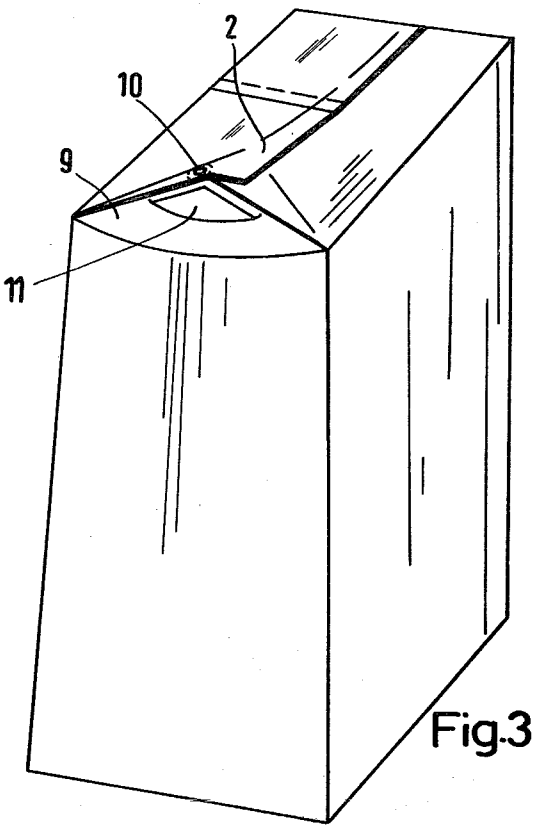
FIG. 3 is a view of the opened container of the design shown in FIGS. 1 and 2.

The packaging container for liquids, illustrated in perspective in FIGS. 1 to 5 and made of cardboard coated on both sides with plastic, is in the form of a rectangular parallelepiped having an upper end-wall 1 comprising a double-thickness cardboard strip 2 which extends from one outer apex 3 of front triangular flap 4 to the apex of the opposite triangular flap, not shown. The lower triangular flaps are visible only in FIGS. 9 to 11, but they bear no reference numerals since they are not essential to the invention.

Figure 1:
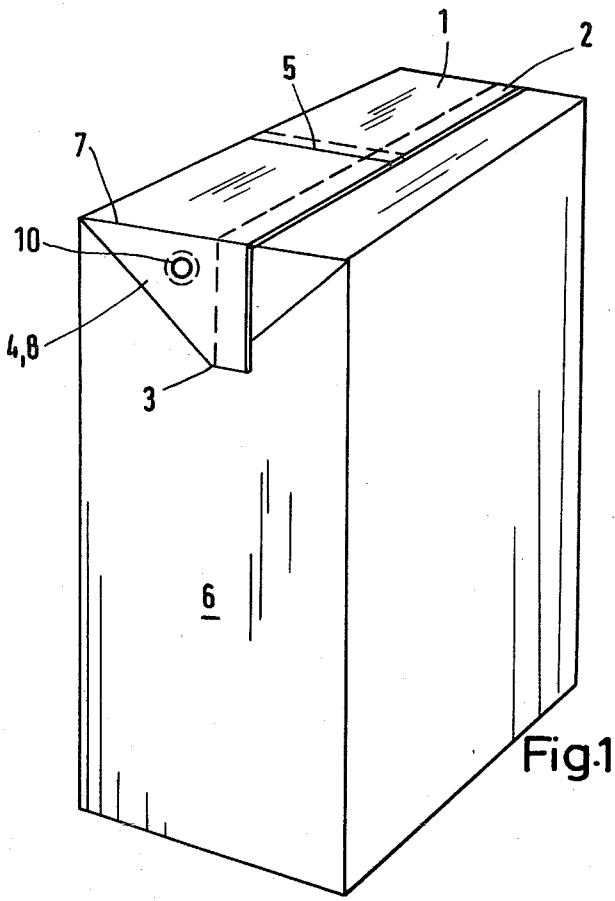
FIG. 1 shows a first example of a packaging container for liquids, provided with a pouring outlet and an air-inlet, in the sealed condition ready for transportation and storage.
Figure 11:
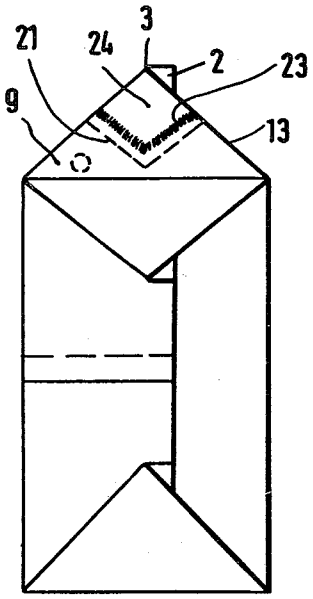
FIGS. 9 to 12 are views of the container with raised triangular flaps according to FIGS. 2 and 7, but seen from below and with different designs of pouring spout.
Figure 10:
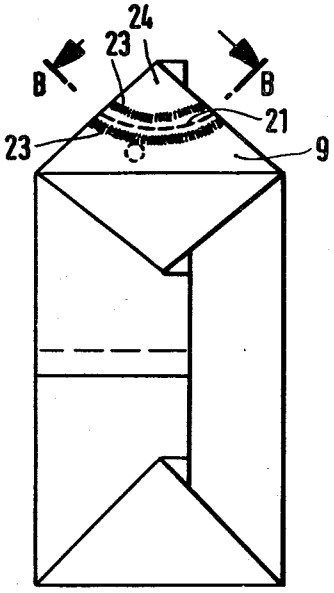
Figure 9:
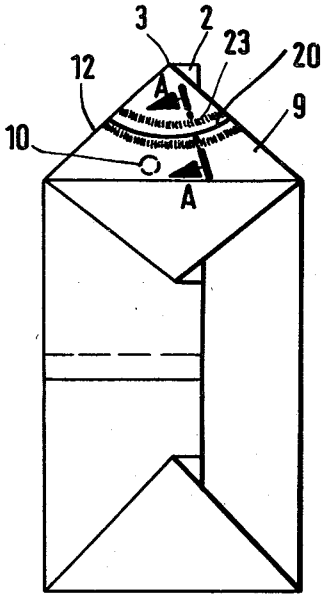

Another double-thickness cardboard strip 5, having a sealing seam, runs transversely across the end-wall 1, terminating, as shown in FIGS. 9 to 11, on the underside and also not shown in detail. A front lateral wall 6 is smooth and is united with the upper end-wall 1 by an edge-line 7 around which the triangular flap 4 is folded downwardly and attached to the front lateral wall 6. The interior of the triangular flap 4 is in direct communication with the interior of the container. The upper triangular wall visible in FIG. 1 is marked 8, while the lower triangular wall visible in FIGS. 3, 4 and 9 to 12 is marked 9.

In the illustrated embodiment the upper triangular wall 8 of the triangular flap 4 contains an air-inlet 10 shown in broken lines in FIGS. 9 to 12, since the view is towards the lower triangular wall 9, and not towards the upper wall 8.

Figure 12:
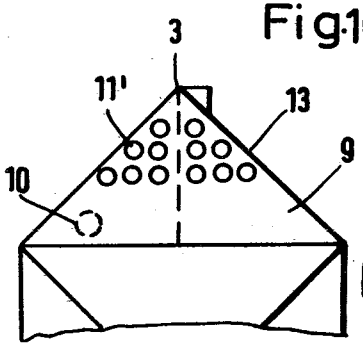

A large pouring spout 11 is located in the lower triangular wall 9 whereas the design according to FIG. 12 shows a plurality of small circular holes 11' representing the pouring spout (on the "salt-shaker" principle).

The production of the opening is best explained in conjunction with FIGS. 9 to 16. FIGS. 9 to 12 show the left-hand fold-edge 12, and the right-hand fold-edge 13 of the triangular flap 4, which converge at the outer apex 3, to which the double-thickness, grippable cardboard strip 2, with its sealing seam, not shown, also runs.

A score-line 20, in the form of an arc, runs from fold-edge 12 to the fold-edge 13, the cross-section thereof being shown in FIG. 14. This is produced with a scoring/welding ram 50 which is shown in FIG. 15 diagrammatically and broken-away, together with a counter-pressure jaw 51.

In the design illustrated in FIGS. 10 and 11, arcuate perforation-line 21 is shown, running from fold-edge 12 to fold-edge 13 across the triangular flap 4, more particularly across the lower triangular wall 9. Instead of being in the form of an arc, this line may be in the form of two straight lines 21 arranged at an angle to each other as shown in FIG. 11.

All the circular holes, namely the air-inlets 10 and the numerous holes in the pouring spout 11 shown in FIG. 12, are produced with a welding/cutting ram 52 in the manner illustrated, the production of the air-inlets 10 in upper triangular wall 8 being shown in FIG. 16. The score-line is therefore marked 22 and may also be seen in FIG. 8, which is a view along the line C—C in FIG. 7.

In the designs according to FIGS. 9 and 10, narrow weld-seams 23 are arranged on both sides of the score-line 21, the weld-seams being also visible in the cross-sections shown in FIGS. 14 to 16. Only in FIG. 11 is another design illustrated, in which a weld-seam 23 is arranged only on the side of the perforation-line 21 facing the outer apex 3. In this design, this is adequate since the perforation-line 21, produced in the strip of cardboard carrier-material prior to the application of the plastic coating, does not produce a leak. Thus the weld-seam 23 in FIG. 11 serves merely to attach the upper wall portion 24 of the lower triangular wall 9 to the upper triangular wall 8.

In the case of the small circular holes 10 and 11', the narrow weld-seams 23 are provided on each side of the circular score-line 22, as shown in FIG. 16 on an enlarged scale. In the case of the large pouring spout, the upper wall portion 23 corresponds to area 24' in the case of the small circular openings 10, 11', the area 24' being shown in FIG. 16 in conjunction with the hole 10 and being here, in any case, a part of the upper triangular wall 8. From FIG. 16 it may be seen, however, that the part 24' is also, secured to the underlying welded part of the lower triangular wall 9.

Figure 6:
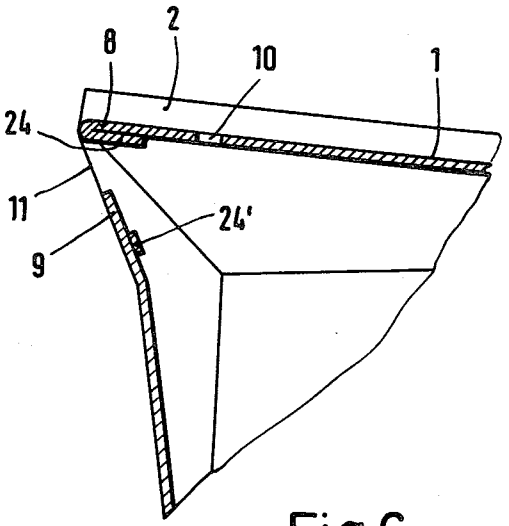
FIG. 6 is a view taken on the line D—D in FIG. 5.

The reason for this joint is that after the weld-seams 23, which provide the seal and are shown in FIG. 16 on each side of the score 22, have been torn open, the parts 24, 24' still adhere. Thus in the case of the circular holes 10, 11', the part 24' remains attached to the opposing triangular wall, whereas the outer weld-seam 23, which prevents leakage, is separated. The results is shown in FIG. 6.

In this case, the air-inlet 10 and the pouring spout 11 are both open. These openings occur because, in the case of the air-inlet 10, the wall portion 24' continues to adhere to the lower triangular wall whereas, in the case of the pouring spout 11, the area 24 continues to adhere to the upper triangular wall 8.

Thus the cross-section shown in FIG. 13, along the line B—B in FIG. 10, is a projection in the direction of the cut, thus making it possible to recognize the webs 30 remaining between the partial cuts which make a perforation-line instead of a score line. The layer 31 of plastic is located under them.

Figure 2:
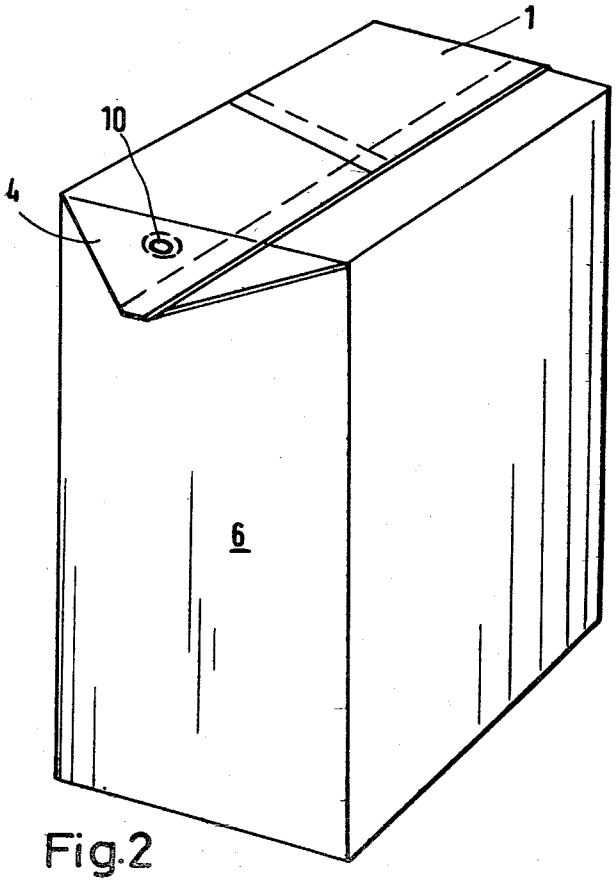
FIG. 2 shows the container of FIG. 1 with the triangular flaps raised, in preparation for opening the container.
Figure 4:
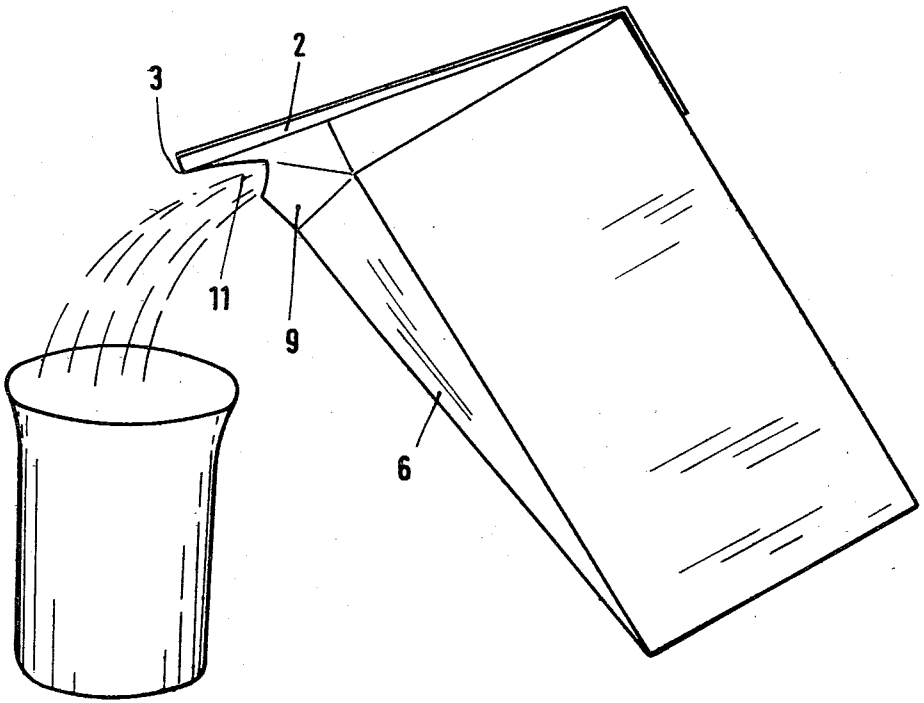
FIG. 4 is a side elevation of the opened container as the liquid is being poured.
Figure 5:
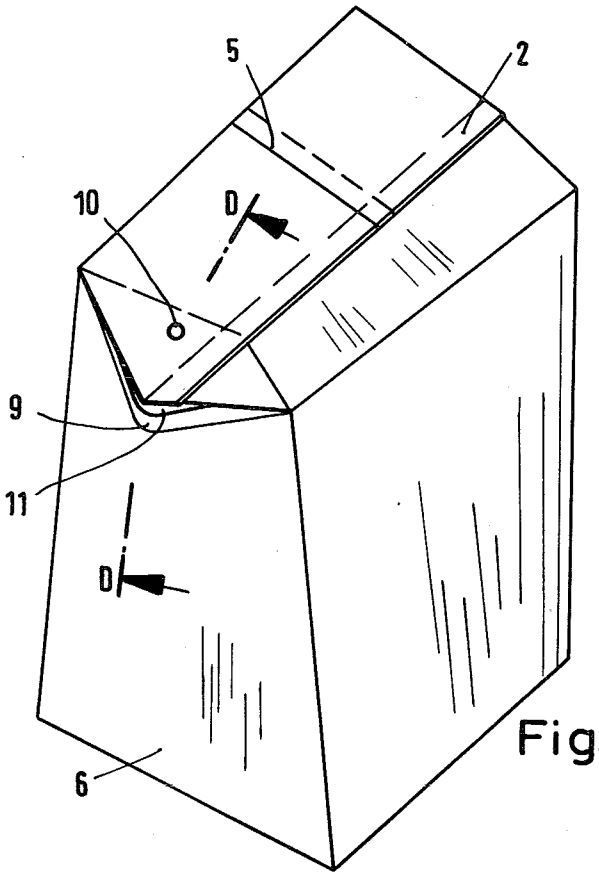
FIG. 5 is a view similar to that in FIG. 3, but seen from above.

As already indicated, the embodiments illustrated in the drawings relate to packaging containers in which an air-inlet 10 is formed at the top, whereas a pouring spout 11, or a plurality of small holes 11', is formed at the bottom in the triangular wall 9. Assuming the container to be in the condition shown in FIG. 1, opening is effected by raising the triangular flaps 4 into the plane of the upper wall 1, as shown in FIG. 2, whereupon the user grips the double cardboard strip 2 with his fingers and pulls it up in relation to the container. This causes the front wall 6 to become somewhat narrower at the top and the outer apex 3 shifts slightly upwards out of the plane of the upper wall 1 which becomes arched. FIGS. 3 and 5 are perspective views of the open container. FIG. 6 shows, in cross-section, how the part 24' was torn out of the upper triangular wall 8, when the container was opened, but still adheres to the opposing lower triangular wall 9, thus providing the air-inlet opening. In a similar manner, the area 24 continues to adhere to the upper triangular wall 8, thus forming the pouring spout 11. In the manner illustrated in FIG. 4, the contents of the container may be poured out.

Finally, FIG. 8 shows the condition of the unopened container in which only one air-inlet opening 10 is provided. In this case the pouring spout is made in known fashion, manually with a pair of scissors.

What is claimed is:

1. The method of making a packaging container of cardboard, paper or the like which has on at least one side thereof a double-thickness wall portion forming a spout from which the contents of said container can be poured when opened, the interior of which communicates with the interior of the container, which wall portion is provided with a strip of material which can be gripped by the fingers for opening said spout, comprising the steps of:

forming and filling with a liquid and closing such container to form such double-thickness wall portion so that facing sides of said wall portion are in mutual engagement across the area of said spout, and thereafter forming in said wall portion across the area of said spout at least one score line which penetrates through only one of said double-thicknesses of said wall portion along which said wall portion may be severed upon lifting of said strip of material with said fingers to form said spout, forming in said double-thickness wall portion, closely adjacent to said score line across the area of said spout between the interior of said container and said score line, at least one fluid-tight weld seam of relatively narrow configuration adapted to be easily torn apart when said strip of material is lifted by said fingers, and folding said double-thickness wall portion so that the facing sides of said double-thickness wall portion in the area of said score line and said at least one fluid-tight weld seam remain in mutual engagement during transportation prior to opening.

2. The method of claim 1 in which another weld seam is positioned at the opposite side of said score line.

3. The method of claim 1 in which said score line and said weld seam are applied simultaneously.

* * * * *